US006899117B2

(12) United States Patent
Marks

(10) Patent No.: US 6,899,117 B2
(45) Date of Patent: May 31, 2005

(54) MOUNTING ASSEMBLY AND METHOD

(76) Inventor: Kipley Roydon Marks, 61 St Heliers Bay Road, St Heliers, Auckland (NZ)

( * ) Notice: Subject to any disclaimer, the term of this patent is extended or adjusted under 35 U.S.C. 154(b) by 237 days.

(21) Appl. No.: 10/306,164

(22) Filed: Nov. 29, 2002

(65) Prior Publication Data

US 2003/0127136 A1 Jul. 10, 2003

(30) Foreign Application Priority Data

Nov. 30, 2001 (NZ) ..... 515889
Apr. 3, 2002 (NZ) ..... 518122

(51) Int. Cl.[7] ..... F17D 3/00; F16I 5/00
(52) U.S. Cl. ..... 137/15.01; 137/360; 251/356
(58) Field of Search ..... 137/360, 15.01; 251/356

(56) References Cited

U.S. PATENT DOCUMENTS 1,562,981 A * 11/1925 Muend ..... 137/360
1,919,233 A * 7/1933 Lee ..... 137/556.3
4,662,389 A * 5/1987 Igbal ..... 137/359
5,076,319 A * 12/1991 Salley ..... 137/360
5,085,742 A 2/1992 Dollard et al. ..... 205/188
5,358,735 A 10/1994 Kawasaki et al. ..... 427/115
6,065,491 A * 5/2000 Rider ..... 137/360
6,165,553 A 12/2000 Chen et al. ..... 427/240

* cited by examiner

*Primary Examiner*—A. Michael Chambers
(74) *Attorney, Agent, or Firm*—Young & Thompson

(57) ABSTRACT

A mounting assembly is disclosed for mounting an object, such as a valve or a spa jet about an aperture in a wall such as a bath or shower wall. The assembly has the advantage that the object can be mounted such that it projects a predetermined distance from the front surface of the wall and can be secured to the wall by rotating a member on the front side of the wall. The invention also provides a valve assembly having relief between sealing surfaces to prevent the valve member seizing.

18 Claims, 4 Drawing Sheets

MOUNTING ASSEMBLY AND METHOD

FIELD OF THE INVENTION

This invention relates to a mounting assembly and method for mounting apparatus, such as a valve assembly, in a wall, such as the wall of a bath or shower installation. The invention also relates to a valve assembly for use with a domestic water supply or a recirculating water supply such as a bath or shower installation.

BACKGROUND OF THE INVENTION

There are many instances where it is desirable to locate apparatus such as a spa jet or valve assembly, for example, in a wall of a bath or shower installation. In these applications it is desirable to have the apparatus project a constant distance from the front surface of the wall, independent of the thickness of the wall. One particular example of this occurs in various shower bath installations where the wall of the shower can vary in thickness from one installation to another. Often valve assemblies need to be mounted in such walls. These valve assemblies need to project a constant known distance from the front surface of the wall. A constant projection distance is important since the front part of the apparatus typically has a removable fascia of predetermined depth. The fascia provides the apparatus which is mounted in the wall with a desirable aesthetic appearance. To allow the fascia to fit correctly, and thus provide the desired aesthetic affect, the projection distance of the apparatus needs to be kept constant from one installation to another.

Presently, when mounting apparatus in a wall, using an aperture in the wall, the apparatus usually has a threaded protrusion that is placed through the aperture. A shoulder at one end of the protrusion sits against the wall on one side of the aperture, and a nut which co-operates with the thread is tightened so that it contacts the opposite side of the wall to securely fasten the apparatus to the wall.

It is difficult to achieve a constant projection distance for the part of the apparatus protruding from the front of the wall. This is because, in order to accommodate for the variation in wall thickness, the nut needs to contact the rear surface of the wall to accommodate the wall thickness. However, in many wall mounted assemblies, particularly in the case of valve assemblies, the size and position of the valve on the rear side of the wall is such that it can be almost impossible for a user to get access to the nut to tighten it.

Also, in valve arrangements that are intended to operate using domestic water supplies, particularly for diverter valve assemblies, the assemblies are prone to seizing as a result of foreign matter, such as dirt particles, in the water becoming wedged between sealing faces of the valve members, There is a need for a wall mounting assembly and/or a valve assembly which overcomes these problems.

OBJECT OF THE INVENTION

It is an objection of the present invention to provide a mounting assembly or method or to provide a valve assembly which will at least go some way toward overcoming disadvantages of existing constructions and methods, or which will at least provide the public with a useful choice.

SUMMARY OF THE INVENTION

In one aspect the invention provides a mounting assembly for mounting an object about an aperture in a wall, the assembly including a sleeve provided about a part of the object provided in the aperture, the sleeve being capable of rotational movement relative to the object, a rear nut for contacting a rear surface of the wall and having a thread thereon adapted to engage with a corresponding thread on the sleeve, the rear nut having movement means which allow the nut to move axially relative to the object, but substantially prevent rotation of the rear nut relative to the object, and a front wall contacting member adapted to engage with the sleeve or the object for contacting a front surface of the wall, whereby rotation of the sleeve relative to the body moves the rear nut into contact with the rear surface of the wall so that the rear nut and the front wall contacting member contact either side of the wall to secure the object thereto.

In a further aspect the invention provides a method of mounting an object about an aperture in a wall, the method comprising the steps of providing a sleeve about a part of the object to be provided in the aperture, the sleeve being capable of rotational movement relative to the object, providing a rear nut on a rear end of the sleeve, the rear nut being capable of moving axially relative to the body, but being substantially incapable of rotating relative to the body, disposing the sleeve through the aperture such that the rear nut is adjacent to a rear surface of the wall, engaging a front wall contacting member with the sleeve or the object, and rotating the sleeve from a front end of the sleeve relative to the housing to move the rear nut into contact with the rear face of the wall so that the rear nut and the front wall contacting member contact either side of the wall to secure the object thereto.

In a further aspect the invention consists in a valve assembly or method of mounting a valve assembly in accordance with the preceding statements of invention.

In a further aspect the invention provides a valve assembly having a housing, a valve member to be received in the housing, the valve member having a control stem, an inlet/outlet port provided substantially opposite the control stem, and the valve member being locatable in the housing through the inlet/outlet port.

In a further aspect the invention provides a valve assembly having a valve housing and a valve member which is moveable relative to the valve housing, and relief means provided on the valve member or the valve housing, the relief means not being provided on sealing faces.

In a further aspect the invention provides a valve assembly having a housing, a valve member within the housing, the valve member including a control stem for a user to manipulate the valve member, the valve member including a housing sealing surface and the valve housing including a valve member sealing surface, the two surfaces being selectively engaged with each other in use to provide a seal between the valve member and the housing, and non-sealing surfaces adjacent to the sealing surfaces of the valve member or the housing having a relief means to allow matter entrained in the liquid which passes through the valve to escape from surfaces between the valve housing and the valve member to thereby prevent the valve from seizing.

In a further aspect the invention provides a valve having a housing with an inlet port and an outlet port, a valve member within the housing, the valve member including a control stem for a user to manipulate the valve member, the valve member being capable of being disposed in a first position to allow flow of a liquid from the inlet port to the outlet port and a second position to substantially prevent a liquid from flowing from the inlet port to the outlet port, the valve member including a housing sealing surface and the valve housing including a first valve member sealing surface and a second valve member sealing surface, the sealing surfaces being selectively engaged with each other in use to provide a seal between the valve member and the housing when the valve member is in the first position and when the valve member is in the second position respectively, and non-sealing surfaces adjacent to the sealing surfaces of the valve member or the housing having a relief means to allow matter entrained in the liquid which passes through the valve when the valve member is being manipulated between the first or second positions to escape from surfaces between the valve housing and the valve member to thereby prevent the valve from seizing.

In a further aspect the invention provides a valve having a housing with an inlet port and an outlet port, a valve member within the housing, the valve member including a control stem for a user to manipulate the valve member, the valve member being capable of being disposed in a first position to allow flow of a liquid from the inlet port to the outlet port and a second position to substantially prevent a liquid from flowing from the inlet port to the outlet port, the valve member including a housing sealing surface and the valve housing including a valve member sealing surface, the sealing surfaces being selectively engaged with each other in use to provide a seal between the valve member and the housing when the valve member is in the second position, and non-sealing surfaces adjacent to the sealing surfaces of the valve member or the housing having a relief means to allow matter entrained in the liquid which passes through the valve when the valve member is being manipulated between the first or second positions to escape from surfaces between the valve housing and the valve member to thereby prevent the valve from seizing.

To those skilled in the art to which the invention relates, many changes in constructions and widely different embodiments and applications of the invention will suggest themselves without departing from the scope of the invention as defined in the appended claims. The disclosure and descriptions herein are purely illustrative and are not intended to be in any sense limiting.

DRAWING DESCRIPTION

The invention consists of the foregoing and also envisages constructions of which the following gives examples only.

One presently preferred embodiment of the invention will now be described with reference to the accompanying drawings, wherein;

FIG. 1 is a front elevation in cross section of a mounting assembly according to the invention including a valve apparatus FIG. 2 is a partial side elevation of FIG. 1, FIG. 3 is an end elevation of FIG. 1, FIG. 4 is a partial cross section of an alternative end cap assembly to that of FIG. 1, FIG. 5 is a front elevation in cross section of a mounting assembly including a valve apparatus according to a further embodiment of the invention, FIG. 6 is an end elevation in cross section through line AA of FIG. 5, FIG. 7 is a further elevation in cross section of the valve member of FIGS. 5 and 6

DETAILED DESCRIPTION

Figure 1:
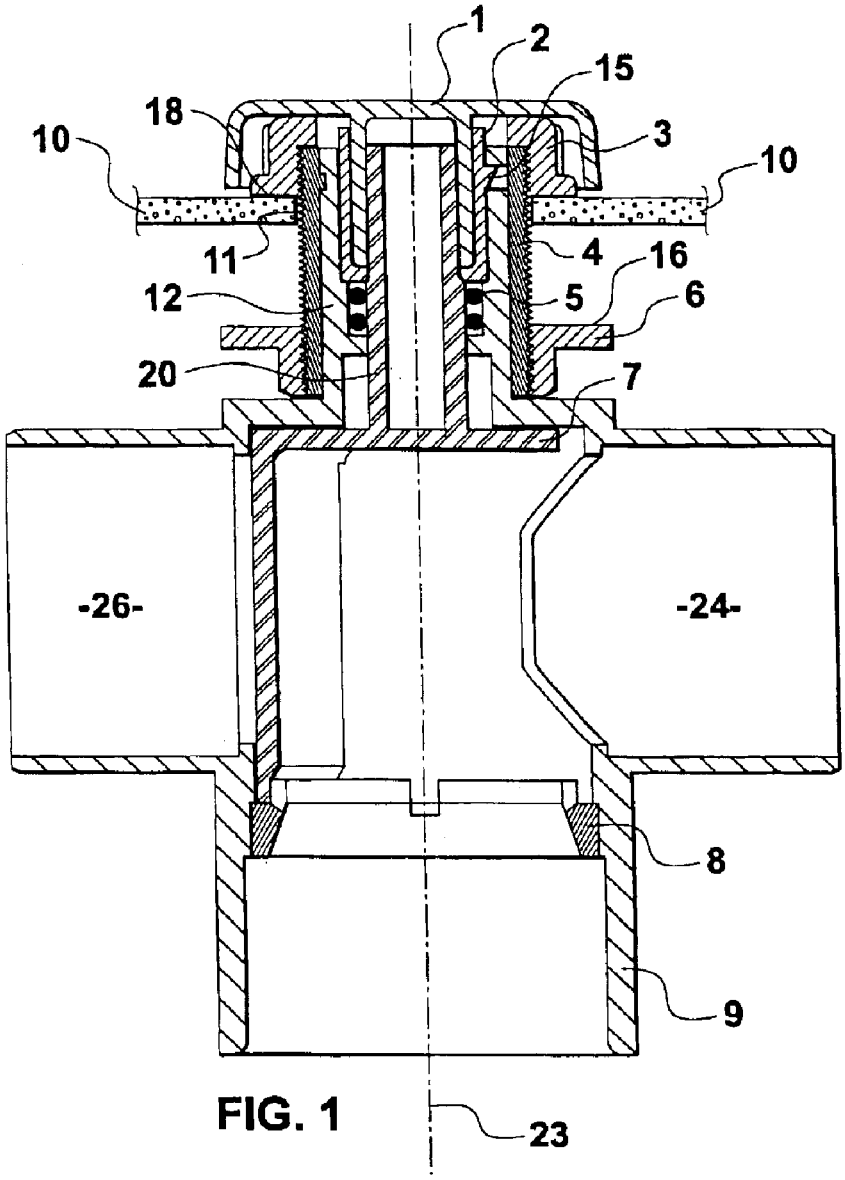

Referring to the drawings, a mounting assembly for an object such as a valve apparatus is shown. Throughout this description, and in the drawings, reference is made to a valve assembly which illustrates one example of an application of the mounting assembly provided by the invention.

In FIG. 1, the apparatus has an end cap 1 that is adapted to be manipulated by a user to operate a valve. The end cap is provided adjacent to an O-ring retainer 2 which retains O-rings 5. A front wall contacting member or front nut 3 is provided within the end cap and the front nut 3 has a thread that engages with a threaded outer surface of sleeve 4. A stem 12 is provided from the body or housing of the valve assembly that is to be mounted about the wall aperture 11 to the wall 10, and the sleeve 4 is free to rotate about stem 12. However, stem 12 has a slight recess within which a protruding part 14 of sleeve 4 is provided to prevent the sleeve from being removed from stem 12. The only way for the sleeve to escape is by expanding, but the nut 3 prevents this. The retainer 2 has a barb 15 to keep it in place. Although not shown in the drawings, the material either side of the barb 15 is removed so as to mount the barb on a narrow resilient piece of material so that the barb may be deflected inwardly using a finger or a tool to allow the retainer to be removed.

Figure 2:
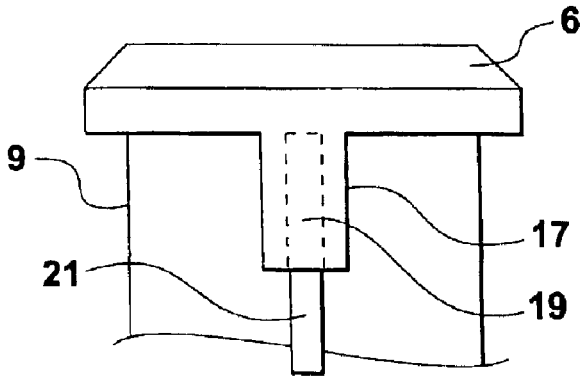

Also provided in threaded engagement with sleeve 4 is a rear nut 6 which has a surface 16 that in use contacts the rear surface of the wall 10 to which the assembly is to be attached. Similarly, the front nut 3 has a surface 18 that is intended to contact the front surface of the wall 10. The rear nut 6 has at least one, but preferably two arms 17, which can be seen in greater detail in FIGS. 2 and 3. As can be seen in FIG. 2, each arm 17 has a slot 19 therein, each of which receives a rib 21 on either side of the housing. The result of this construction is that nut 6 can move axially, but cannot rotate relative to the housing.

The cap 1 is engaged with a valve stem 20 of a moveable valve member 7 by using a key, or by simple frictional engagement for example, so that it can be pushed on for engagement and pulled off to disengage. The valve member 7 can be rotated within housing 9 by a rotational movement of cap 1 about central axis 23 to allow water flow between conduits 22 and 24 or between conduits 22 and 26. The valve member 7 is placed in the housing from the rear and held in place by the retainer 8.

Figure 3:
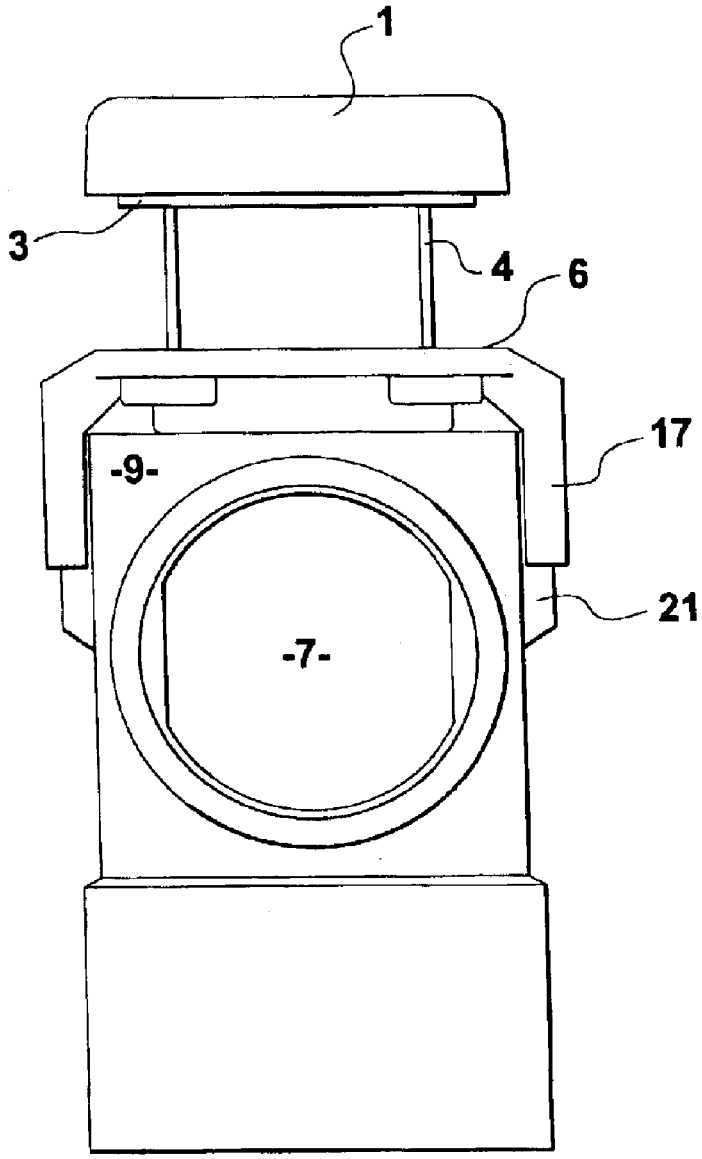

The apparatus is shown in FIG. 3 from an external view as an end elevation for further clarity.

Figure 4:
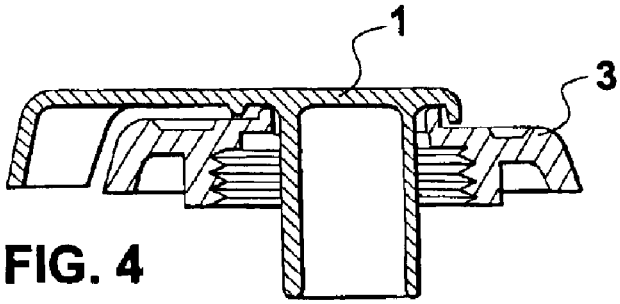

In FIG. 4, the cap 1 is shown replaced by a lever rather than a cap which totally surrounds nut 3.

The manner in which the apparatus is mounted to the wall will now be described. Firstly, the apparatus is provided with nut 3 and cap 1 removed. The protruding part of the assembly i.e. that part of the assembly encapsulated within the sleeve 4, is placed from behind the wall through an aperture in wall 10. The nut 3 is then engaged with the thread of the sleeve 4 and is rotated so as to move the nut 3 along the sleeve towards the wall. As can be seen from the drawing, a rear surface 28 of the nut provides a stop member which will eventually contact the end of the sleeve, preventing further rotation of the nut relative to the sleeve. This limits the axial distance that nut 3 can travel along the sleeve, so there is a predetermined projection distance of the valve from the front of the wall 10. When surface 28 contacts the front end of the sleeve, continued rotation of the nut will rotate the sleeve 4 relative to the stem 12 of the body. The continued rotation of the nut rotates the whole sleeve such that bottom nut 16 begins to move axially along the sleeve toward the rear surface of wall 10. This axial movement occurs because rear nut 16 is prevented from rotating with the sleeve by virtue of the ribs 21 provided on the housing.

Eventually, surface 16 of the rear nut will contact the rear surface of wall 10 such that a secure engagement is made about the wall by nut 3 and 6. The cap 1 is then pushed into place to complete the assembly an to provide a desirable aesthetic appearance.

Figure 5:
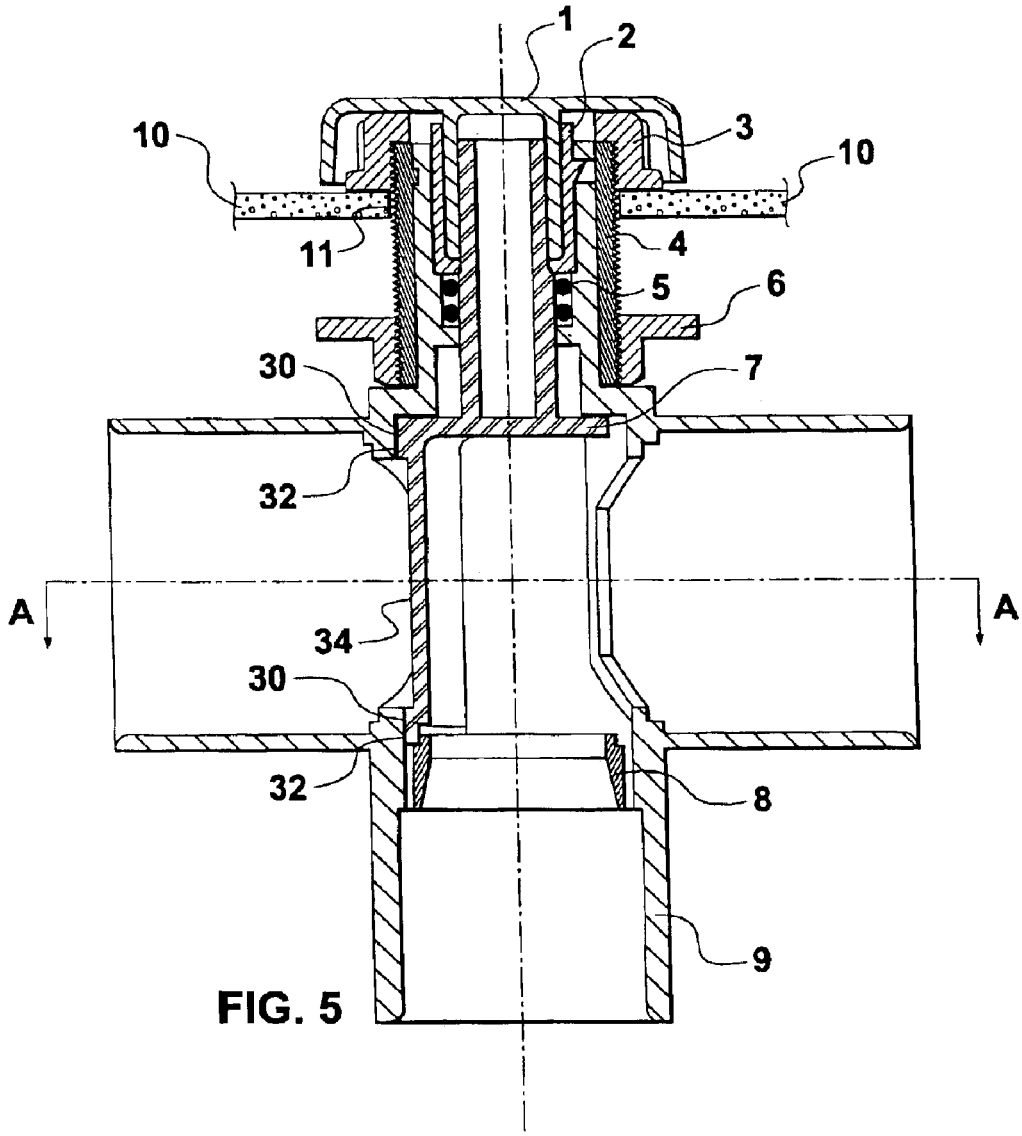
Figure 6:
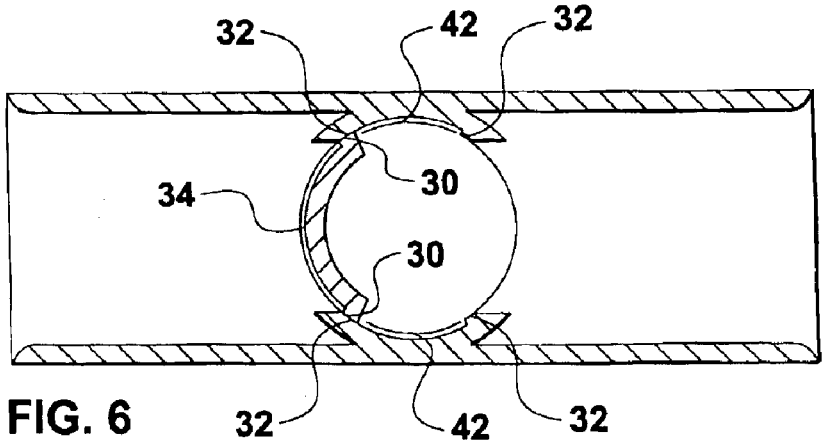
Figure 7:
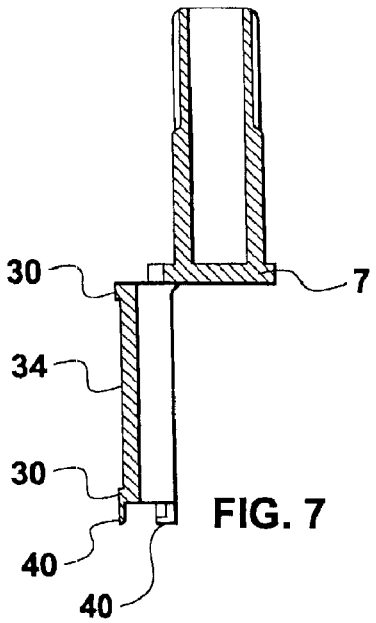
Figure 9:
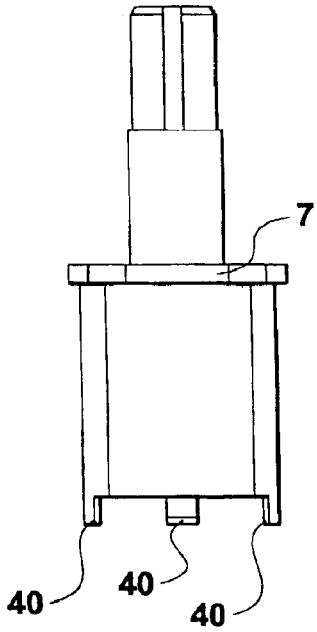
FIG. 9 is an end elevation of the valve means of FIG. 7, but shown from the opposite side.
Figure 8:
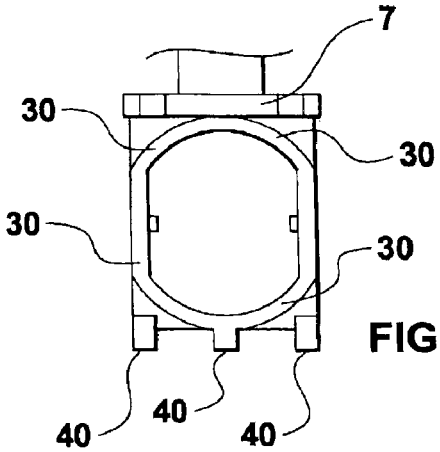
FIG. 8 is a partial end elevation of the valve means of FIG. 7.

Turning now to the embodiment shown in FIGS. 5 to 9, this construction is substantially the same as that shown in the preceding figures, and reference numerals used in the preceding figures are also used in the embodiment shown in FIGS. 5 to 9 to designate like features. The embodiment shown in FIGS. 5 to 9 includes relief on the valve member and on the housing. Therefore, as shown in FIG. 5, the valve member 7 is now provided with distinct sealing surfaces 30 that make sealing contact with corresponding sealing surfaces 32 on the housing. As can be seen from the drawing Figures, between the sealing surface 30 of the valve member, there is a recess or area of relief 34. This is also shown clearly in FIG. 6, and in the separate view in cross section of the valve member shown in FIG. 7. The fingers 40 maintain alignment of the valve member by being located in use between the housing and the retaining ring 8. The sealing surface on the valve member is shown in FIG. 8. The corresponding sealing surfaces 32 of the housing are provided adjacent to each outlet, specifically about the inner periphery of each of the apertures for conduits 24 and 26. Therefore, there is a recess or relief 42 provided on inner circumferential surfaces of the housing.

The valve described with reference to FIGS. 5 to 9 may be modified by blocking inlet port 22 and using one of ports 24 or 26 as the inlet port. In this way the valve may act as a blocking valve or flow control valve. In this embodiment the sealing surfaces 32 adjacent to one of the ports will not be required.

Areas of relief 34 and 42 allow space for particles of dirt or other matter which are entrained in the liquid that the valve is diverting in use to escape from between the sealing surfaces and minimises the chances of capture and hence seizing. Therefore, unlike the previous embodiment, where there are substantial areas that provide the sealing surfaces between the valve member and the housing, and where any entrained dirt would tend to remain between the surfaces because they were of large area, the sealing surfaces have now been restricted to specific areas, and the regions between specific sealing surfaces have been provided with areas of recess or relief. Conveniently, the areas of relief are provided on both the valve member and the housing. As can be seen, if the valve member is rotated, it is now very probable that any small particles which are trapped in the scaling area between the valve member and the housing, will be moved to one of the areas of relief, where the water movement within the housing can flush the particles of dirt or other matter clear.

The invention therefore also provides a novel and practical diverter valve assembly, and a mechanism or means for clearing the assembly of particulant matter which would otherwise be prone to preventing desired operation of the assembly, or causing it to seize.

From the foregoing, it will be seen that a quick and convenient method and apparatus is provided for securely mounting apparatus to a wall. Although the example provided shows a diverter valve assembly which has been affixed to a wall, it will be appreciated by those skilled in the art that the invention is applicable to a wide variety of other devices which may need to be mounted within an aperture in a wall. As can be seen from the drawing figures, the part of the mounting apparatus which protrudes from the front surface of the wall is kept to a constant known dimension which makes it easy to provide an aesthetically pleasing appearance to the assembly and provides minimal protrusion into the environment on the front surface of the wall.

What is claimed is:

1. A method of mounting an object about an aperture in a wall, the method comprising the steps of providing a sleeve about a part of the object to be provided in the aperture, the sleeve being capable of rotational movement relative to the object, providing a rear nut on a rear end of the sleeve, the rear nut being capable of moving axially relative to the body, but being substantially incapable of rotating relative to the body, disposing the sleeve through the aperture such that the rear nut is adjacent to a rear surface of the wall, engaging a front wall contacting member with the sleeve or the object, and rotating the sleeve from a front end of the sleeve relative to the housing to move the rear nut into contact with the rear face of the wall so that the rear nut and the front wall contacting member contact either side of the wall to secure the object thereto.

2. A method as claimed in claim 1 wherein the step of engaging the front wall contacting member with the sleeve or the object comprises engaging the front wall contacting member with the sleeve.

3. A method as claimed in claim 1 including the step of providing a stop member on the front wall contacting member so that the front wall contacting member is limited to a predetermined extent of axial engagement with the sleeve.

4. A method as claimed in claim 3 including the step of rotatably engaging the front wall contacting member with the sleeve and continuing to rotate the front wall contacting member once the predetermined extent has been reached to rotate the sleeve relative to the object.

5. A mounting assembly for mounting an object about an aperture in a wall, the assembly including a sleeve provided about a part of the object provided in the aperture, the sleeve being capable of rotational movement relative to the object, a rear nut for contacting a rear surface of the wall and having a thread thereon adapted to engage with a corresponding thread on the sleeve, the rear nut having movement means which allow the nut to move axially relative to the object, but substantially prevent rotation of the rear nut relative to the object, and a front wall contacting member adapted to contact a front surface of the wall and to support the object relative to the front surface of the wall, whereby rotation of the sleeve relative to the body moves the rear nut into contact with the rear surface of the wall so that the rear nut and the front wall contacting member contact either side of the wall to secure the object thereto.

6. An assembly as claimed in claim 5 wherein the front wall contacting member is adapted to be engaged with a front end of the sleeve.

7. An assembly as claimed in claim 5 wherein the front wall contacting member includes a thread which allows the front wall contacting member to engage with the sleeve.

8. An assembly as claimed in claim 5 wherein the front wall contacting member includes a stop member which allows rotation of the front wall contacting member to rotate the sleeve.

9. An assembly as claimed in claim 8 wherein the stop member allows the front wall contacting member to engage with the sleeve over a predetermined axial distance along the sleeve.

10. An assembly as claimed in claim 5 wherein the front wall contacting member comprises a front nut having a thread corresponding to the thread on the sleeve and rotation of the nut relative to the sleeve moves the front nut axially relative to the sleeve, and the front nut includes a stop member which limits the extent of axial movement to a predetermined axial distance.

11. A valve having a housing with an inlet port and an outlet port, a valve member within the housing, the valve member including a control stem for a user to manipulate the valve member, the valve member being capable of being disposed in a first position to allow flow of a liquid from the inlet port to the outlet port and a second position to substantially prevent a liquid from flowing from the inlet port to the outlet port, the valve member including a housing sealing surface and the valve housing including a valve member sealing surface, the sealing surfaces being selectively engaged with each other in use to provide a seal between the valve member and the housing when the valve member is in the second position, and non-sealing surfaces adjacent to the sealing surfaces of the valve member or the housing having a relief means to allow matter entrained in the liquid which passes through the valve when the valve member is being manipulated between the first or second positions to escape from surfaces between the valve housing and the valve member to thereby prevent the valve from seizing.

12. A valve as claimed in claim 11 wherein there is a first and a second outlet port and the valve member may be manipulated between the first and second positions to allow or to prevent liquid flow through one of the first or second outlet ports, the valve housing having a first valve member sealing surface adjacent to the first outlet port and second valve member sealing surface adjacent to the second outlet port.

13. A valve as claimed in claim 12 wherein the inlet port is provided substantially opposite the control stem, and the valve member is locatable in the housing through the inlet port.

14. A valve as claimed in claim 12 wherein the valve diverts liquid in a first direction when the valve member is disposed in the first position and diverts liquid in a second opposite direction when the valve member is disposed in the second position.

15. A valve as claimed in claim 12 wherein the valve diverts liquid from bathroom plumbing to one or more bathroom fixtures.

16. A valve as claimed in claim 12 wherein the valve is a diverter valve.

17. A valve as claimed in claim 11 wherein the relief means are provided on both the valve member and the valve housing.

18. A valve as claimed in claim 11 wherein a retaining ring is provided for engagement with the housing to retain the valve member in the housing.

* * * * *